US006509286B2

(12) United States Patent
Albin

(10) Patent No.: US 6,509,286 B2
(45) Date of Patent: Jan. 21, 2003

(54) TEXTILE SUBSTRATE

(75) Inventor: Kälin Albin, Widnau (CH)

(73) Assignee: Rohner Textil AG, Balgach (CH)

( * ) Notice: Subject to any disclaimer, the term of this patent is extended or adjusted under 35 U.S.C. 154(b) by 149 days.

(21) Appl. No.: 09/784,362

(22) Filed: Feb. 15, 2001

(65) Prior Publication Data

US 2001/0024918 A1 Sep. 27, 2001

(30) Foreign Application Priority Data

Feb. 25, 2000 (CH) ..... 0370/00
Apr. 11, 2000 (DE) ..... 200 06 635 U

(51) Int. Cl.[7] ..... D03D 15/00; D03D 25/00; D04B 21/14

(52) U.S. Cl. ..... 442/209; 66/202; 2/239; 139/420 R; 139/426 R; 139/383 R

(58) Field of Search ..... 442/208, 209, 442/213, 217, 304, 310; 2/239; 66/202; 139/420 R, 426 R, 483 R

(56) References Cited

U.S. PATENT DOCUMENTS

| | | | | | |
|---|---|---|---|---|---|
| 3,060,551 | A | | 10/1962 | Bogaty et al. | |
| 3,642,561 | A | * | 2/1972 | Grobner | 428/102 |
| 3,822,727 | A | * | 7/1974 | Small et al. | 139/383 R |
| 5,065,600 | A | * | 11/1991 | Byles | 66/193 |
| 5,070,915 | A | * | 12/1991 | Kalin | 139/420 A |
| 5,095,548 | A | * | 3/1992 | Chesebro, Jr. | 2/239 |
| 5,167,264 | A | * | 12/1992 | Kalin | 139/420 A |
| 5,422,153 | A | * | 6/1995 | Miyamoto | 428/116 |
| 5,735,145 | A | * | 4/1998 | Pernick | 604/378 |
| 5,858,885 | A | * | 1/1999 | Hamilton et al. | 139/420 A |
| 6,006,550 | A | * | 12/1999 | Singh | 66/13 |
| 6,250,060 | B1 | * | 6/2001 | Scheerer et al. | 19/236 |
| 2001/0024918 | A1 | * | 9/2001 | Albin | 442/310 |
| 2001/0052193 | A1 | * | 12/2001 | Payet et al. | 34/444 |

FOREIGN PATENT DOCUMENTS

| | | |
|---|---|---|
| DE | 177730 | 2/1928 |
| DE | 108781 | 2/1954 |
| DE | 94 10038 U1 | 12/1995 |
| DE | 197 09706 A1 | 9/1998 |
| DE | 198 19 400 A1 | 11/1999 |
| EP | 0 685 583 A | 12/1995 |
| FR | 2776309 | 9/1999 |
| GB | 2228952 A | 9/1990 |
| WO | WO 00/00686 | 1/2000 |

* cited by examiner

*Primary Examiner*—Cheryl A. Juska
*Assistant Examiner*—Lynda Salvatore
(74) *Attorney, Agent, or Firm*—Katten Muchin Zavis Rosenman

(57) ABSTRACT

A textile substrate for seat covering contains about 50 wt % of wool and about 50 wt % of viscose rayon. The substrate can be made exclusively of wool and viscose rayon, but can also contain other constituents such as metal threads and plastic fibers, such as polyesters. The substrate can be formed as a woven fabric, for example, which comprises in the warp a mixed yarn of 30 to 70 wt % of wool and 30 to 70 wt % of viscose rayon and in the weft a mixed yarn of 30 to 70 wt % of wool and 30 to 70 wt % of viscose rayon alternating with a pure viscose rayon yarn.

9 Claims, 1 Drawing Sheet

TEXTILE SUBSTRATE

FIELD OF THE INVENTION

The invention relates to a textile substrate that has water-wicking properties and comprises wool as well as at least one other fiber. Such substrates are characterized by excellent ability to absorb and wick off water vapor and water. They are suitable in particular for seat coverings, especially coverings on elongated seats that are used without interruption, as in cars, buses, trains and aircraft, as well as for office chairs, wheelchairs, etc. The good wicking of moisture from the fabric surface helps to achieve good sitting comfort, because the seat covering does not become damp even if the seat has been occupied for a long time, but instead always feels dry and thus guarantees "climatized sitting".

BACKGROUND OF THE INVENTION

From European Patents 356708, 455848 and 685583 there are known textile substrates of the class in question, each of which discloses a proportion of natural fibers, especially wool and ramie. In this connection, this proportion of natural fibers ranges between 65 and 85 wt % of wool and ramie (European Patent 356708), it amounts to at least 40 wt % of wool and at least 5% of ramie (European Patent 455848) or it comprises at least 40% of wool and at least 15% of ramie, but the two together always exceed 85 wt % (European Patent 685583).

Whereas European Patents 356708 and 455848 each require a proportion of synthetic fibers as well—whether for the purpose of water wicking or of better dyeability—European Patent 585583 discloses a textile substrate for seat coverings, a woven fabric, a single-thread knitted fabric or a multi-thread knitted fabric, which contains a mixed yarn comprising 80 wt % of wool and 20 wt % of ramie in the warp and ramie threads in the weft.

Initially it seemed extremely doubtful whether extensive or even total avoidance of synthetic fibers would not restrict the creative options of the material designer too much and in particular detract from the excellent properties of known textiles of the class in question as regards water absorption and wicking. The first problem is less serious, and can be circumvented by appropriately adapted color schemes. For fluid transport, however, it seemed indispensable for long-term purposes to provide a relatively high proportion—at least 15 wt %—of synthetic fibers, preferably polyesters, since their hydrophobic properties have been credited with fluid transport over relatively long distances. Surprisingly, however, it had been found that the same function is achieved by ramie fiber when it is present in adequate concentration—at least 15 wt %—in the substrate. Judging by its chemical composition—degummed ramie comprises substantially cellulose—this behavior could not have been expected. The fact that ramie is also able to transport water over relatively long distances was attributed to strong capillary action, which in turn is due to the fact that the ramie fibers form tubes which are additionally provided in the interior with longitudinal grooves. As a logical development, the requirement was established that the ramie content in a textile substrate must be at least 15 wt % in order to satisfy the strict requirements of wicking of moisture from the fabric surface and to guarantee good sitting comfort.

SUMMARY OF THE INVENTION

Surprisingly it has now been found that—if the ramie fibers are left out and replaced by viscose rayon fibers—practically equivalent wicking of moisture from the fabric surface can nevertheless be maintained.

These inventive textiles comprise at least extensively, but preferably exclusively, natural fibers, and can therefore be disposed of very safely from the environmental viewpoint: The inventive textiles can be chopped to pieces, heaped up and stored at sufficiently high humidity and temperature; they decompose completely and thus can be composted properly.

In any case the discovery of the fact that viscose rayon fibers remove water over long distances forms the basis for a surprisingly simple solution of the object of providing, for seat coverings, an alternative textile substrate that not only is extremely comfortable, in that it always feels dry even after prolonged, uninterrupted use under adverse conditions such as high temperatures and high relative humidity, but also it causes very little environmental pollution and in particular can be effectively disposed of and decomposes under suitable conditions with the least possible residues that must be disposed of.

BRIEF DESCRIPTION OF THE DRAWINGS

Incidentally the textile substrate can be made in various ways, as woven fabric, single-thread knitted fabric or multi-thread knitted fabric, especially as raschel, malimo or velour. Such practical examples are schematically illustrated in the figures, wherein.

DETAILED DESCRIPTION OF THE INVENTION

The inventive substrate comprises at least 40 wt % of wool and at least 30 wt % of viscose rayon, the total of the proportions of wool and viscose rayon being more than 80%. In all other respects the inventive substrate preferably comprises exclusively substances which decompose or at least are toxicologically and ecotoxicologically safe, so that it can be composted without restriction. Under these conditions it can also be provided with a finish corresponding to different requirements. For example, to prevent electrostatic charges, it can contain less than 5 wt % of metal fibers or wire. If these metal threads are chosen appropriately, they oxidize under suitable conditions and decompose together with the other constituents. The use of elastic fibers is also entirely possible, since the content of any such fibers that do not decompose, such as Lycra® (registered trademark of Du Pont de Nemours) can be kept very low—to less than 5 wt %—or decomposing material such as natural rubber can be used instead. Elastic fibers can be incorporated in the substrate, for example, in that individual threads are made completely of such material or a yarn comprising substantially viscose rayon, in the weft of a fabric, for example, is spun together with elastic fibers.

Although synthetic fibers such as polyester, polypropylene, polyacryl or aramide are not particularly detrimental in small proportions, it is preferable in the interests of unrestricted compostability to avoid them and to ensure that all fibers used—aside from possible admixtures of metal fibers—are of animal or vegetable origin. Suitable in particular besides wool is viscose rayon that has been obtained from beechwood and in addition has preferably been mixed with a flame-retarding agent in an environmentally safe process. Instead of the corresponding viscose rayon, fibers obtained from other plants are also suitable.

In a very favorable embodiment the substrate comprises a mixed yarn of wool and viscose rayon, preferably one made of about 30 to 70 wt % of wool and 30 to 70 wt % of viscose rayon. In the case of a woven fabric, the warp or the weft for example, can be made of such a mixed yarn. while the weft or the warp is made of other material, such as pure (100 wt %) viscose rayon, or contains proportions of other materials. In such substrates and others, it has proved possible and even favorable to use exclusively wool and viscose rayon and to avoid other admixtures entirely, unless they are necessary to meet special requirements.

Figure 1:
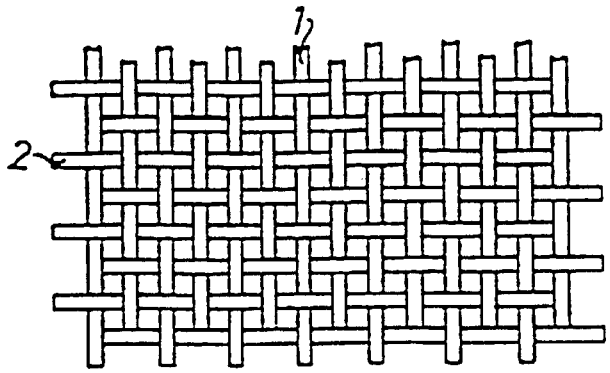
FIG. 1 shows a woven fabric.

Thus FIG. 1 shows an inventive woven fabric according to a first embodiment, whose warp 1 is formed from a mixed yarn of 60 wt % of wool and 40 wt % of viscose rayon, whereas weft 2 comprises viscose rayon threads. A specially preferred embodiment is a corresponding woven fabric whose weft comprises a mixed yarn of 60 wt % of wool and 40 wt % of viscose rayon alternating with a pure viscose rayon yarn. Overall this results in a wool proportion of about 50 wt % and a viscose rayon proportion of about 50 wt %. Naturally other compositions of the type described hereinabove are also possible. Thus, in an inventive textile substrate or woven fabric according to a second embodiment, weft 2 can be formed from a mixed yarn of 30 to 70 wt % of wool and 30 to 70 wt % of viscose rayon, while warp 1 comprises viscose rayon threads 2. In this case a specially preferred form is a corresponding woven fabric whose warp 1 comprises a mixed yarn of 30 to 70 wt % of wool and 30 to 70 wt % of viscose rayon alternating with a pure viscose rayon yarn. In especially preferred cases of such an alternation of mixed yarn and pure viscose rayon yarn—whether in weft 2 according to the first embodiment or in warp 1 according to the second embodiment—the ratio ranges from 1:1 to 4:1, or in other words preferably 1 to 4 mixed yarns are used per pure viscose rayon yarn. An example of suitable viscose rayon fibers are those sold under the name "Redesigned Viscose FR" by Lenzing AG at A-4860 Lenzing, Austria.

In fact, for two different woven fabrics, each comprising about 50 wt % of wool and viscose rayon, the following absorption capacities, which are typical of efficiently water-wicking substrates, were measured in the capillary rise method according to DIN 53924:

| | Fabric 1 | | Fabric 2 | |
|---|---|---|---|---|
| | 1 hour | 3 hours | 1 hour | 3 hours |
| Warp | 17.0 cm | >25.0 cm | 17.9 cm | >25.0 cm |
| Weft | 13.6 cm | 18.1 cm | 13.5 cm | 17.9 cm |

On the one hand, fire regulations are becoming increasingly stricter for public buildings such as theaters, schools or sports stadiums, for hotels, restaurants and offices, and even for private dwellings. Particularly strict criteria also apply in aircraft, ships and other means of transportation. On the other hand, it is being increasingly required that flame-proofed products also must be produced and disposed of in a manner that is environmentally safe. Because flame-proofed products are usually incompatible with environmental safety, the tendency only too often is to choose the "lesser evil" and to insist unilaterally on protection against fire.

Because it is now possible by virtue of the inventive textile substrate to use viscose rayon—in combination with wool—as a completely adequate substitute for ramie, a further advantage is now derived from the fact that viscose rayon fibers have been successfully impregnated with a flame retardant in an environmentally safe manner, thus creating a textile substrate that is free of potential environmental pollutants. Thus the compost obtained from the inventive textile substrates can also be used safely, in gardens, for example, if it had formerly been a flame-retarding textile.

Thus it has become possible for the first time to provide, for seat coverings, a textile substrate which:

- is extremely comfortable, in that it always feels dry even during prolonged uninterrupted use under adverse conditions such as high temperatures and high relative humidity;
- has such good flame retardancy that the fire-protection regulations for seat coverings are met worldwide;
- does not harm the environment from the viewpoint of toxicity and ecotoxicity either due to production or to disposal.

Figure 2:
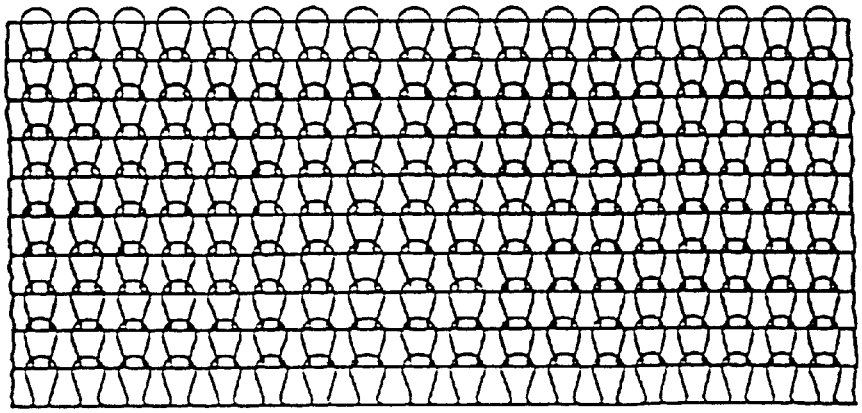
FIG. 2 shows a weft raschel and FIG. 3 shows a malimo, the weft direction being horizontal in each case.
Figure 3:
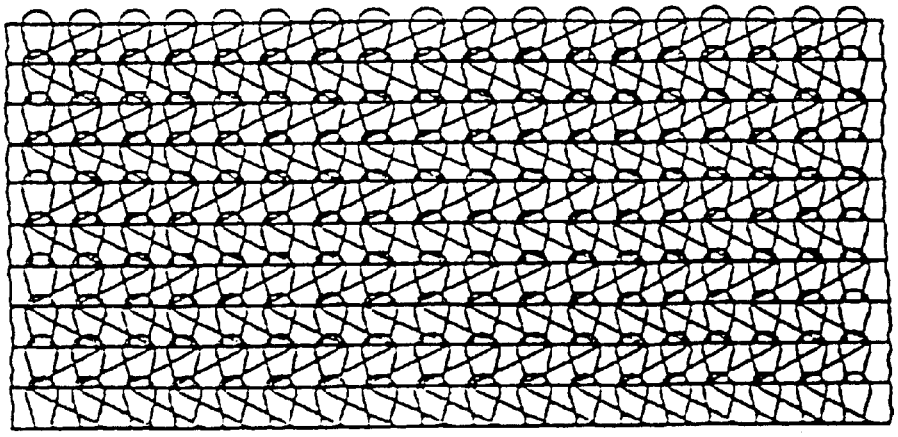

The textiles impregnated with a flame retardant meet all corresponding safety requirements of the automobile, aviation and transportation industry and of the respective countries which have passed legislation. There is no longer any barrier to the most extensive use of such inventive substrates as seat coverings, interior linings in public buildings, in automobiles, aircraft and trains, etc., not to mention other furnishings and decorative articles in public, commercial or private use. In addition, experts are increasingly taking the position that a better sitting climate in the automobile can improve safety in highway traffic. FIGS. 2 and 3 show further typical substrates (weft raschel in FIG. 2 and malimo in FIG. 3), which can also be used in one of the ways summarized hereinabove.

I claim:

1. A textile substrate which has water-wicking properties and comprises wool as well as at least viscose rayon fibers, comprising:

- the warp or the weft comprises a mixed yarn of 30 to 70 wt % of wool and 30 to 70 wt % of viscose rayon and
- the weft or the warp comprises a mixed yarn of 30 to 70 wt % of wool and 30 to 70 wt % of viscose rayon alternating with a yarn of 100 wt % of viscose rayon.

2. A textile substrate according to claim 1, comprising:

the warp or the weft comprises a mixed yarn of 60 wt % of wool and 40 wt % of viscose rayon and the weft or the warp comprises a mixed yarn of 60 wt % of wool and 40 wt % of viscose rayon alternating with a yarn of 100 wt % of viscose rayon.

3. A textile substrate according to claim 1, wherein the weft or the warp comprises a mixed yarn alternating with a 100 wt % viscose rayon yarn in a ratio of 1:1 to 4:1.

4. A textile substrate according to claim 1, wherein said textile substrate comprises 40 to 70 wt % of wool and 30 to 60 wt % of viscose rayon.

5. A textile substrate according to claim 1, wherein said textle substrate comprises velour, woven fabric, multi-thread knit fabric, raschel or malimo.

6. A textile substrate according to claim 1, wherein said textile substrate contains less than 5 wt % of elastic fibers and/or metal and/or synthetic fibers.

7. A textile substrate according to claim 1, wherein the viscose rayon fibers are impregnated with a flame retardant.

8. A textile substrate according to claim 1, wherein said textile substrate is made exclusively of materials which decompose and which are toxicologically and ecotoxicologically safe.

9. A textile substrate according to claim 2, wherein the weft or the warp comprises a mixed yarn alternating with a 100 wt % viscose rayon yarn in a ratio of 1:1 to 4:1.

* * * * *